US012274321B2

(12) United States Patent
Pflug

(10) Patent No.: US 12,274,321 B2
(45) Date of Patent: Apr. 15, 2025

(54) EYELASH APPLICATOR STAND AND METHOD

(71) Applicant: Kimberly Pflug, Albuquerque, NM (US)

(72) Inventor: Kimberly Pflug, Albuquerque, NM (US)

( * ) Notice: Subject to any disclaimer, the term of this patent is extended or adjusted under 35 U.S.C. 154(b) by 880 days.

(21) Appl. No.: 17/432,636

(22) PCT Filed: Feb. 23, 2020

(86) PCT No.: PCT/US2020/019396
§ 371 (c)(1),
(2) Date: Aug. 20, 2021

(87) PCT Pub. No.: WO2020/172646
PCT Pub. Date: Aug. 27, 2020

(65) Prior Publication Data

US 2022/0132967 A1 May 5, 2022

Related U.S. Application Data

(60) Provisional application No. 62/809,596, filed on Feb. 23, 2019.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A45D 26/0066; A45D 44/02; A45D 44/04; A45D 44/14; A45D 27/29; B65G 7/12; B01L 19/50
See application file for complete search history.

(56) References Cited

U.S. PATENT DOCUMENTS 2,847,121 A * 8/1958 Neugebauer ..... A47F 7/02 206/480
3,556,113 A 1/1971 Frieder
4,852,929 A * 8/1989 Shafir ..... A61B 17/30 294/99.2
8,424,542 B1 4/2013 Han
(Continued)

FOREIGN PATENT DOCUMENTS

GB 1021063 A 2/1966
WO WO 2002/066208 A1 8/2002
WO WO 2016/153773 A1 9/2016

OTHER PUBLICATIONS

Chae et al. Machine Translation (Year: 2018).*

*Primary Examiner* — Rachel R Steitz
*Assistant Examiner* — Karim Asqiriba
(74) *Attorney, Agent, or Firm* — Santa Fe IP, LLC

(57) ABSTRACT

An eyelash applicator stand provides hands-free support of a false eyelash. The stand includes an elongated slot in a body, with the elongated slot having a length L and a width W dimensioned and configured to receive the fulcrum and the lever arms of an eyelash applicator, and having a height H dimensioned and configured to receive a portion of the lever arms. The width W is dimensioned and configured to sufficiently squeeze the lever arms together in order to pinch the tips of the lever arms together when the eyelash applicator is inserted into the elongated slot. A method of using the eyelash applicator stand is also disclosed.

17 Claims, 5 Drawing Sheets

(56) References Cited

U.S. PATENT DOCUMENTS

| | | | |
|---|---|---|---|
| 8,757,913 | B2 | 6/2014 | Geuther et al. |
| 9,314,085 | B2 | 4/2016 | Hatch |
| 2005/0166939 | A1 | 8/2005 | Stroud |
| 2012/0282008 | A1 | 11/2012 | Geuther et al. |

* cited by examiner

EYELASH APPLICATOR STAND AND METHOD

CROSS-REFERENCES TO RELATED APPLICATIONS

This application is a National Stage of International Patent Application No. PCT/US2020/019396 filed Feb. 23, 2020 and published as WO 2020/172646 A1 on Aug. 27, 2020, which claims priority to U.S. Provisional Patent Application No. 62/809,596 filed Feb. 23, 2019, the entire contents of which is incorporated herein by this reference.

BACKGROUND OF INVENTION

Field of Invention

This application relates to a stand for holding tweezers in a closed position, and more particularly to an eyelash applicator stand for holding false eyelashes while adhesive dries, along with methods of use.

Description of Related Art

False or artificial eyelashes are increasingly more popular with the fashion conscience. Unfortunately, applying false eyelashes ranks high in terms of difficulty when it comes to makeup. Generally, one must apply an adhesive to a strip of a false eyelash, wait for the adhesive to dry enough to become tacky, and then apply the false eyelash to their real lashes by lining up the strip of the false eyelash with their lash line.

While it is possible to apply false eyelashes by simply grasping a false eyelash with one's index finger and thumb, many opt to use tweezers or an eyelash applicator to grasp and hold the false eyelashes. When doing so, however, a user must continuously squeeze the lever arms of the eyelash applicator in order to hold a false eyelash, including the extended period of time necessary for the adhesive to sufficiently dry. Continuously squeezing the eyelash applicator in the closed position can become burdensome, and a user may inadvertently drop the eyelash if the user does not diligently squeeze the eyelash applicator or is otherwise distracted.

It would therefore be useful to provide a stand and method for supporting and holding false eyelashes which overcomes the above and other disadvantages of applying false eyelashes, and more generally allows one to support tweezers holding an item in a handsfree manner.

BRIEF SUMMARY

One aspect of the present invention is directed to an eyelash applicator and stand for hands-free support of a false eyelash, the eyelash applicator and stand including: an eyelash applicator including a pair of lever arms interconnected at a fixed end by a fulcrum, and each lever arm having a tip at a free end, wherein when the lever arms are squeezed together to pinch the tips of the lever arms together in order to engage and hold the false eyelash; and a stand including an elongated slot in a body, the elongated slot having a length L and a width W dimensioned and configured to receive the fulcrum and the lever arms of the eyelash applicator, and the elongated slot having a height H dimensioned and configured to receive a portion of the eyelash applicator lever arms; wherein the width W is dimensioned and configured to sufficiently squeeze the lever arms together in order to pinch the tips of the lever arms together when the eyelash applicator is inserted into the elongated slot.

The tips may pinch together when the eyelash applicator is inserted the height H into the elongated slot.

The stand may include a pair of said elongated slots in the body configured to receive a pair of said eyelash applicators in order to support a pair of said false eyelashes.

Each slot may be oriented at an oblique angle to the other slot, whereby the oblique orientation provides clearance between the pair of eyelash applicators to facilitate a user in gripping and removing one of said eyelash applicators from the stand.

The stand may include a plurality of said elongated slots in the body, each configured to receive a respective eyelash applicator.

The body may be a solid mass defining the elongated slot.

The body may include an outer wall defining the overall shape of the stand and an inner wall defining the elongated slot.

The body may further include a bottom wall defining a bottom of the elongated slot.

The stand may include a weight inserted within the outer wall to provide a stable base having a low center of gravity.

The stand may further include an adjustor for adjusting the width W of the elongated slots in order to accommodate different eyelash applicators of varying sizes.

The adjustor may include a threaded member that threadably extends through the stand body into the elongated slot, whereby screwing the threaded member into the elongated slot decreases an effective width W of the elongated slot.

The adjustor may include a wedge having a threaded member that extends through the stand body and engages a wedge, tightening the treaded member moves the wedge within the body to bias a side wall of the wedge into the elongated slot to decrease an effective width W of the elongated slot.

The stand may further include a fan for directing air toward the tips of an eyelash applicator received within the elongated slot for drying adhesive applied to a false eyelash held by the eyelash applicator.

The fan may be mounted within the body of the stand.

The stand may further include a timer for tracking the time of drying adhesive that has been applied to a false eyelash held by the eyelash applicator received in the elongated slot.

The timer may be mounted within the body of the stand.

Another aspect of the present invention is directed to a stand for hands-free support of an item with tweezers, the tweezers including a pair of lever arms interconnected at a fixed end by a fulcrum, and each lever arm having a tip at a free end, wherein when the lever arms are squeezed together to pinch the tips of the lever arms together in order to engage and hold the item, the stand including: an elongated slot in a body, the elongated slot having a length L and a width W dimensioned and configured to receive the fulcrum and the lever arms of the tweezers, and the elongated slot having a height H dimensioned and configured to receive a portion of the lever arms; wherein the width W is dimensioned and configured to sufficiently squeeze the lever arms together in order to pinch the tips of the lever arms together when the tweezers are inserted into the elongated slot.

The tips may pinch together when the tweezers are inserted the height H into the elongated slot.

The stand may further include an adjustor for adjusting the width W of the elongated slots in order to accommodate different tweezers of varying sizes.

The adjustor may include a threaded member that threadably extends through the stand body into the elongated slot, whereby screwing the threaded member into the elongated slot decreases an effective width W of the elongated slot.

A further aspect of the present invention is directed to a method for hands-free support of an item with tweezers, the tweezers including a pair of lever arms interconnected at a fixed end by a fulcrum, and each lever arm having a tip at a free end, wherein when the lever arms are squeezed together to pinch the tips of the lever arms together in order to engage and hold the item, the method including: providing a stand including an elongated slot in a body, the elongated slot having a length L and a width W dimensioned and configured to receive the fulcrum and the lever arms of the tweezers, and the elongated slot having a height H dimensioned and configured to receive a portion of the lever arms, wherein the width W is dimensioned and configured to sufficiently squeeze the lever arms together in order to pinch the tips of the lever arms together when the tweezers are inserted into the elongated slot; positioning the tips around the item and gripping the item between the tips by squeezing the lever arms together; inserting the tweezers into the elongated slot while squeezing the lever arms together; and releasing the tweezers while inserted in the elongated slot, whereby width W causes the elongated slot to sufficiently squeeze the lever arms together while the tweezers remain inserted in the elongated slot.

Inserting the tweezers into the elongated slot the height H may cause the stand to squeeze the lever arms together and thus cause the tips to pinch together.

The stand may further include an adjustor for adjusting the width W of the elongated slots in order to accommodate different tweezers of varying sizes, and the method may further include adjusting the adjustor.

The adjustor may include a threaded member that threadably extends through the stand body into the elongated slot, and the method may further include screwing the threaded member into the elongated slot to decrease an effective width W of the elongated slot.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
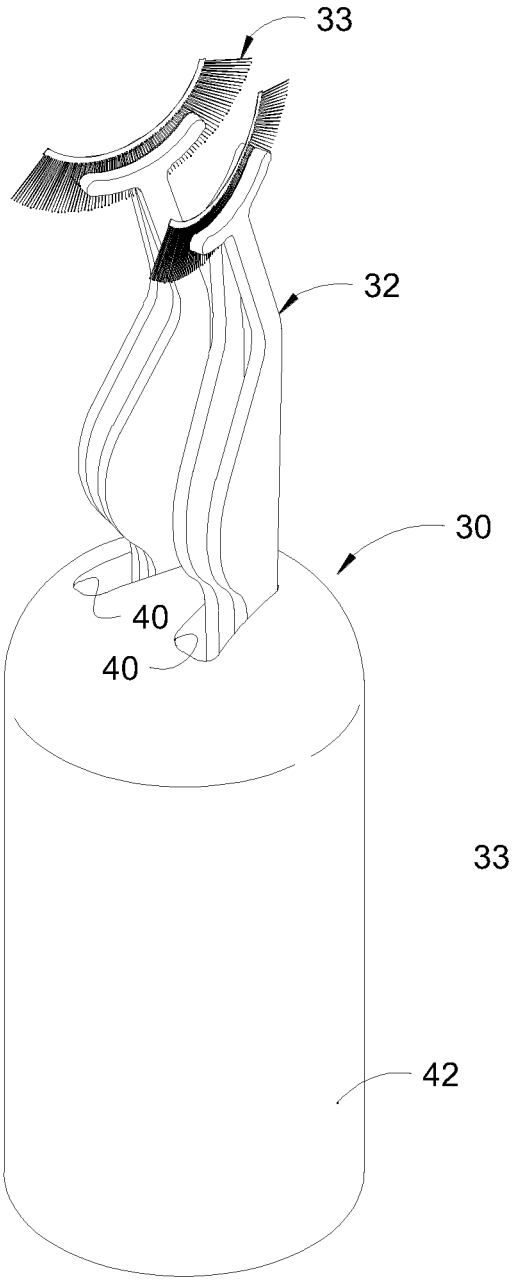
FIG. 1 is a perspective view of an exemplary eyelash applicator stand in accordance with various aspects of the present invention.

Turning now to the drawings wherein like components are designated by like reference numerals throughout the various figures, FIG. 1 shows a stand 30 for hand-free support of tweezers 32 bearing an item 33 pinched therein in accordance with various aspects of the present invention. In the illustrated embodiment, the stand is dimensioned and configured to receive and support an eyelash applicator in such a manner that the eyelash applicator pinches and holds a false or artificial eyelash therein.

Figure 2A:
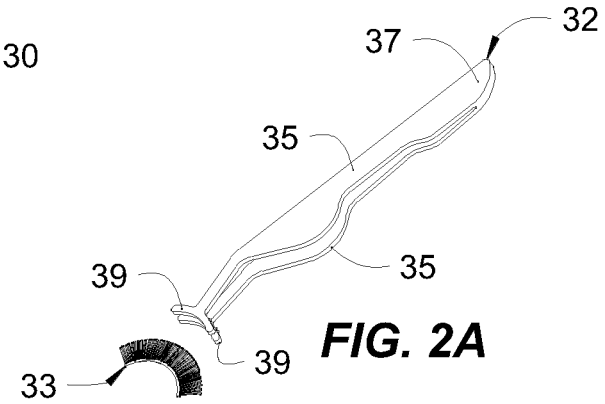
FIG. 2A, FIG. 2B, FIG. 2C are perspective views of an eyelash applicator approaching, engaging and holding a false eyelash.
Figure 2B:
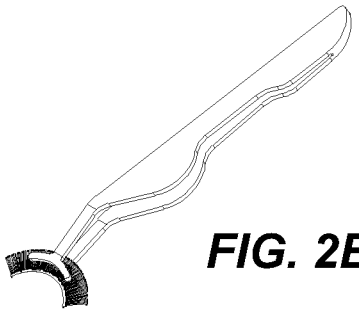
Figure 2C:
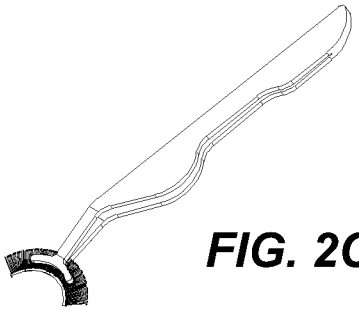

Eyelash applicators are similar to otherwise conventional tweezers in that applicator 32 generally includes a pair of lever arms 35 interconnected at a fixed end by a fulcrum 37, and the terminal end of each lever arm has a tip 39 (see FIG. 2A). As can be seen in FIG. 2A to FIG. 2C, the tips have a sweeping arcuate shape that is specially configured to grip and hold a false eyelash 33 therebetween when the lever arms are squeezed together to pinch the tips of the lever arms together. One will appreciate other types of tweezers may have specially configured tips to hold a wide variety of items.

Figure 4:
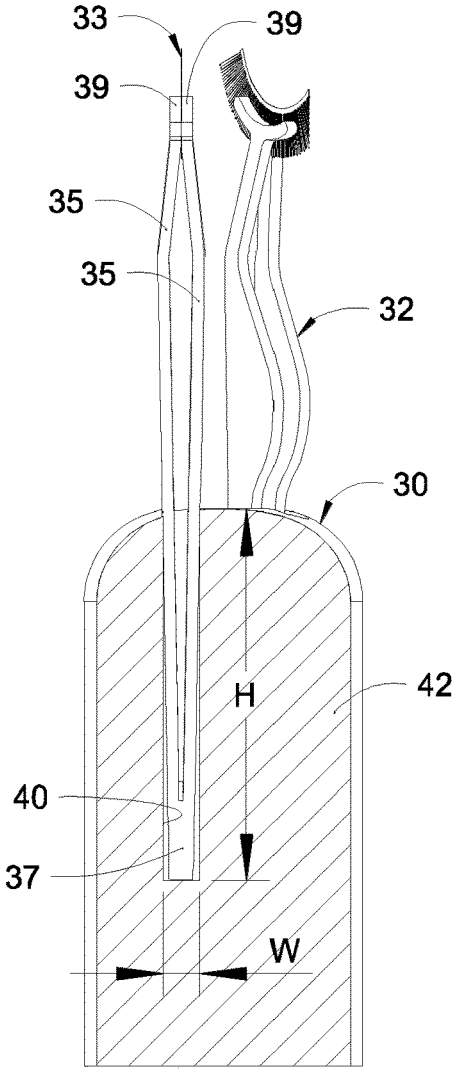
FIG. 4 is a cross-sectional view of the eyelash applicator stand of FIG. 1 taken along line 4-4 in FIG. 3.
Figure 5:
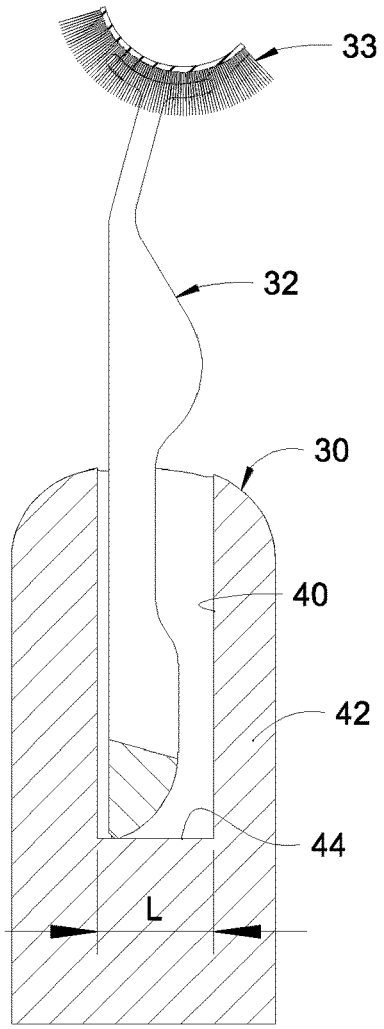
FIG. 5 is a cross-sectional view of the eyelash applicator stand of FIG. 1 taken along line 5-5 in FIG. 3.

With reference to FIG. 4 and FIG. 5, stand 30 generally includes a pair of elongated slots 40 arranged in a body 42 such that a pair of eyelash applicators 32 can be inserted into the slots with the eyelash applicators being sufficiently squeezed to pinch and hold a respective false eyelash 33 in each eyelash applicator. Each elongated slot has a length L and a width W configured and dimensioned to receive fulcrum 37 and lever arms 35 of a respective eyelash applicator. And each elongated slot has a height H configured and dimensioned to receive a portion of the lever arms.

Height H is sufficient to receive a significant length of lever arms 35 in order to provide a stable support of eyelash applicator 32 inserted therein and to hold the eyelash applicator upright within slot 40 of stand 30. Width W is configured and dimensioned to sufficiently squeeze the lever arms together in order to pinch tips 39 of the lever arms together when the tweezers are inserted into the elongated slot. Preferably, width W squeezes the lever arms together such that the tips are fully engaging against one another when lever arms are fully inserted into slot 40 and fulcrum 37 is abutting against a bottom surface 44 of the slot. As such, a user may grasp a false eyelash 33 with the eyelash applicator, continue squeezing the eyelash applicator while inserting it into a slot 40 of stand 30, release the eyelash applicator in the slot, and let the stand support and squeeze the eyelash applicator to provide handsfree support of the false eyelash as shown in FIG. 4 and FIG. 5.

Figure 9:
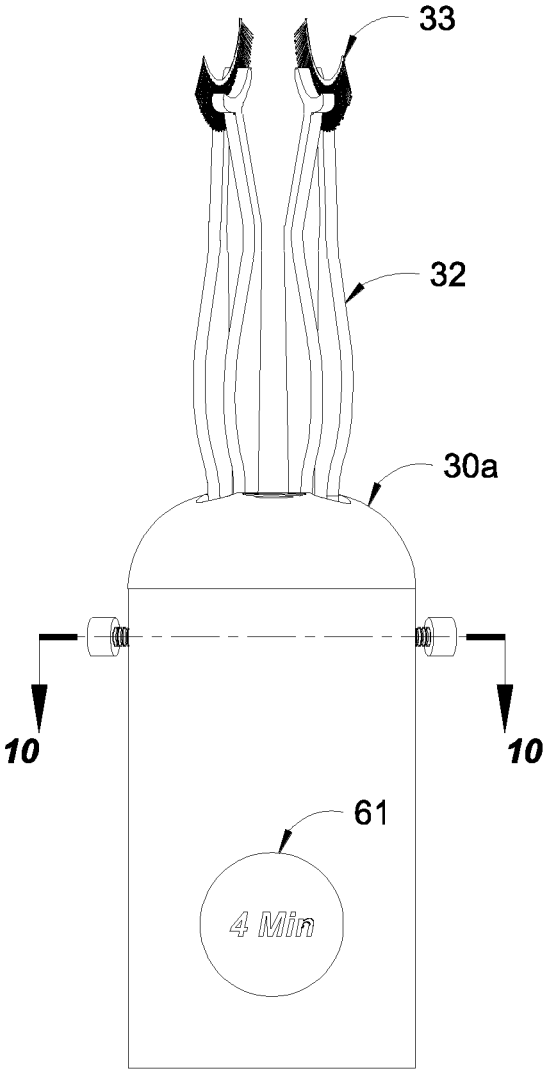
FIG. 9 is a front elevational view of the eyelash applicator stand of FIG. 6.
Figure 10:
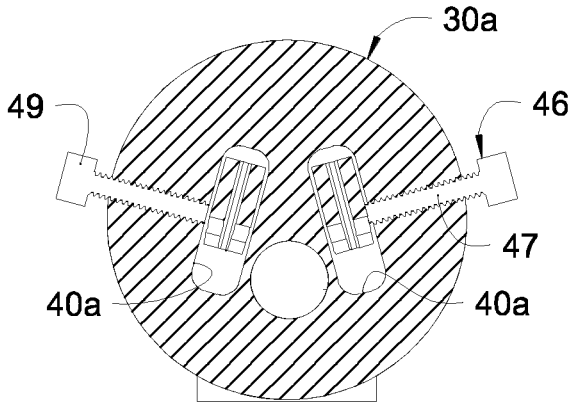
FIG. 10 is a cross-sectional view of the eyelash applicator stand of FIG. 6 taken along line 10-10 in FIG. 9.

In various embodiments, and as shown in FIG. 9 and FIG. 10, the stand may be provided with an adjustor 46 for adjusting the width W of the elongated slots in order to accommodate different tweezers of varying sizes. For example, the adjustor may include a threaded member 47 that threadably extends through stand body 42*a* into the elongated slot 40*a*, whereby screwing the treaded member into the elongated slot decreases an effective width W of the elongated slot. The adjuster may further include a knob 49 to facilitate tightening and loosening of the threaded member to adjust the effective width.

Figure 11:
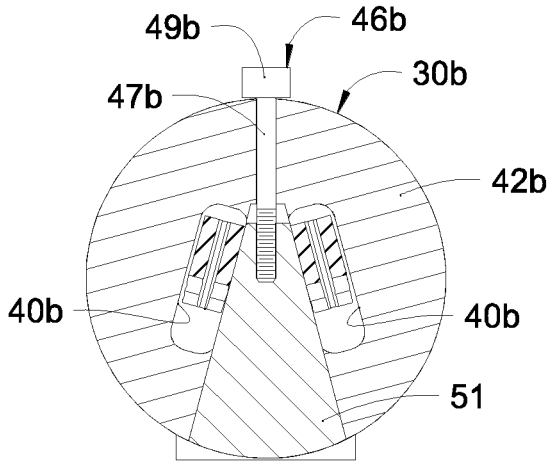
FIG. 11 is a cross-sectional view of another eyelash applicator stand in accordance with various aspects of the present invention, the view being similar to that shown in FIG. 10.

In various embodiments, and as shown in FIG. 11, adjuster 46*b* may include a wedge 51 having a threaded member 47*b* that extends through the stand body 42*b* and engages the wedge. Tightening the treaded member moves the wedge within the body to bias a side wall of the wedge into the elongated slot to decrease an effective width W of the elongated slot. With reference to FIG. 11, tightening threaded member 47*b* would draw the wedge upward relative to the body, whereby left and right-side walls of wedge 51 would protrude further into the respective left and right elongated slots 40*b*. One will appreciate that other configurations may be utilized to adjust the effective width of the elongated slots, including but not limited to shims and other suitable means.

In the illustrated embodiments, including that shown in FIG. 1, stand 30 includes a pair of elongated slots 40 in body 42 configured to receive a pair of eyelash applicators 32 in order to support a pair of false eyelashes 33 while adhesive dries on the pair of false eyelashes. One will appreciate that the stand may include one, two or more elongated slots in order to hold various numbers of tweezers or eyelash applicators.

Figure 3:
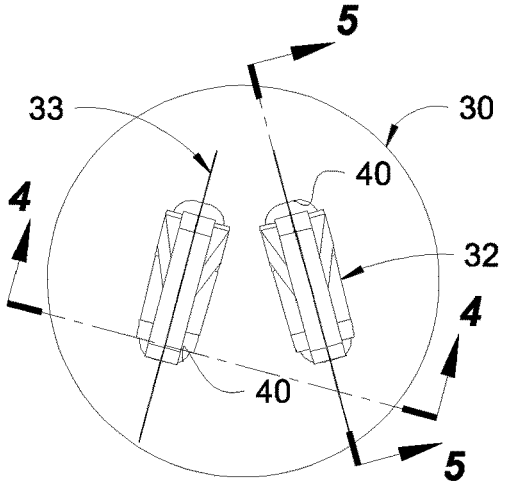
FIG. 3 is a top view of the eyelash applicator stand of FIG. 1.

In various embodiments, each slot 40 is oriented at an oblique angle to the other slot, as clearly seen in FIG. 3. Such an oblique orientation provides ample clearance for a user's thumb or finger between a pair of eyelash applicators inserted in the slots to facilitate a user in gripping and removing one eyelash applicator from the stand without disturbing an adjacent eyelash applicator.

In various embodiments, body 42 is a solid mass defining the elongated slots 40, as shown in FIG. 4 and FIG. 5. Suitable materials for such a solid mass include, but are not limited to ceramics, composites, glasses, metals, polymers, woods and/or other suitable materials. Additive manufacturing such as 3D printing may be utilized to create a desired shape in ceramics, metals and/or polymers. Subtractive manufacturing may be used to machine or mill a desired shape in ceramics, composites, metals, polymers and/or wood. A mold may be used to shape ceramics, glasses, metals and/or polymers.

Figure 12:
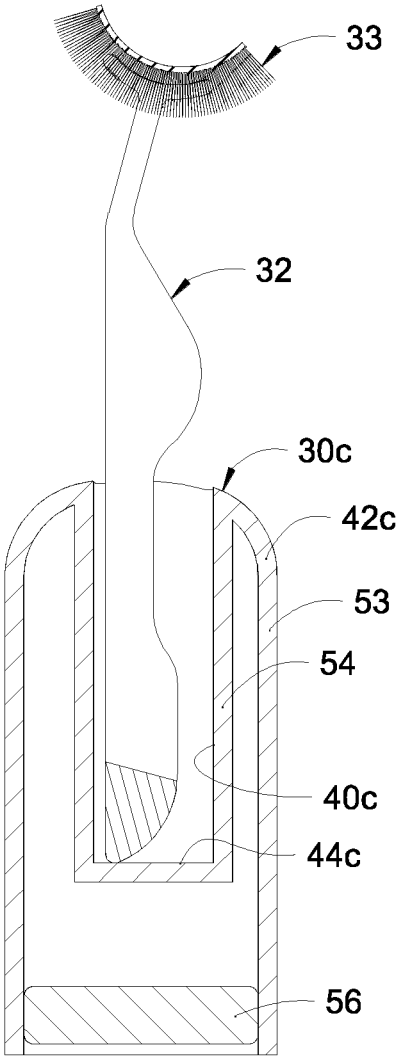
FIG. 12 is a cross-sectional view of another eyelash applicator stand in accordance with various aspects of the present invention, the view being similar to that shown in FIG. 5.

In various other embodiments, body 42*c* is a substantially hollow structure, as shown in FIG. 12. In such embodiments, the body may include an outer wall 53 defining the overall shape of the stand and an inner wall 54 defining the elongated slots 40*c*. The inner wall may also include a bottom wall defining the bottom surfaces 44*c* of the elongated slots. Body 42*c* may be provided with a weight 56 inserted within the outer wall to provide a stable base with a low center of gravity.

Figure 6:
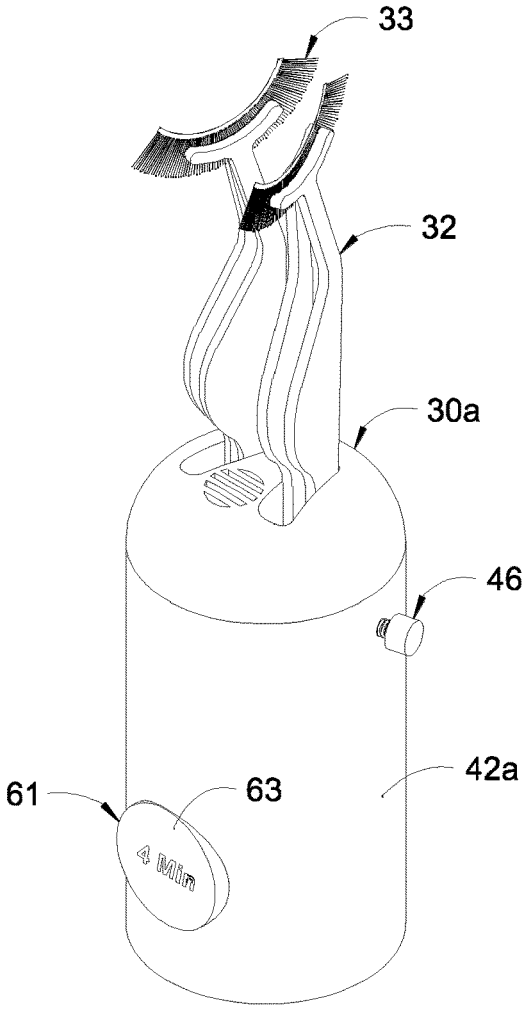
FIG. 6 is a perspective view of another exemplary eyelash applicator stand in accordance with various aspects of the present invention.
Figure 7:
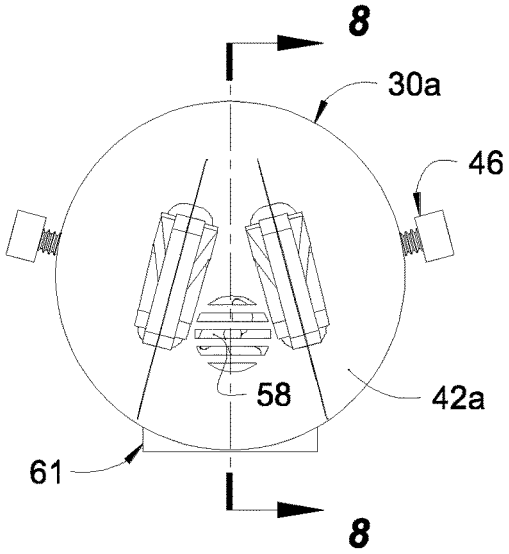
FIG. 7 is a top view of the eyelash applicator stand of FIG. 6.
Figure 8:
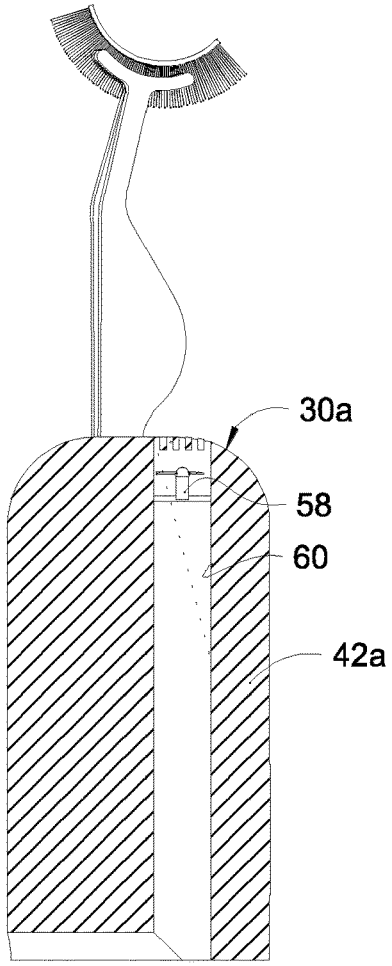
FIG. 8 is a cross-sectional view of the eyelash applicator stand of FIG. 6 taken along line 8-8 in FIG. 7.

In various embodiments, the stand may include a fan for directing air toward the tips of an eyelash applicator received within the elongated slot for drying adhesive applied to a false eyelash held by the eyelash applicator. For example, FIG. 8 shows a stand 30*a* having a fan 58 mounted within passageway 60 for directing air through the passageway upward toward eyelash 33 supported by eyelash applicator 32 supported in an elongated slot of the stand. While FIG. 6 through FIG. 8 show the fan mounted within body 42*a*, one will appreciate that the fan may be mounted external to the body.

In various embodiments, the stand may include a timer 61 for tracking the time of drying adhesive that has been applied to a false eyelash held by the eyelash applicator received in the elongated slot. For example, FIG. 6 through FIG. 8 shows a stand 30*a* incorporating a timer into body 42*a*. One will appreciate that the timer may be analog or digital, and that otherwise conventional means may be utilized to operate the timer. For example, the timer may include a face 63 which shows the set and remaining time, and which face is itself a button to set the time. While FIG. 6 through FIG. 8 show the timer incorporated within body 42*a*, one will appreciate that the timer may be mounted external to the body.

In operation and use, a user will use an eyelash applicator 32 to grasp a false eyelash 33 with tips 39 of the applicator by holding lever arms 35 and squeezing the lever arms to clamp down and squeeze the false eyelash between the tips The user may apply eyelash adhesive or glue to the false eyelash while it is held within the eyelash applicator. The user may then insert eyelash applicator 32 into one of the slots 40 of stand 30 while continuing to squeeze the lever arms 35 together. Once the eyelash applicator is sufficiently inserted into the slot, the width W of the slot (or the effective width in the case of adjustors 46*a*, 46*b*) continue to squeeze the lever arms together thereby causing false eyelash applicator to continue pinch the false eyelash held therein.

In accordance with various aspects of the present invention, stand 30 supports eyelash applicator 32 and causes continued pinching of eyelash 33 by the eyelash applicator so long as the eyelash applicator is supported handsfree within the stand. Accordingly, a user may go on to other activities while stand 30 supports an applicator 32 pinching eyelash 33, and the eyelash glue becomes tacky. Depending on the eyelash glue brand, it may take up to three minutes for the glue to become tacky. Once the eyelash glue is sufficiently tacky, the user may remove applicator 32 from stand 30 while squeezing the applicator in the closed position so that false eyelash 33 remains pinched between tips 39. The user may then apply the false eyelash onto their eyelid and against their lash line by releasing the force applied to the arms applicator 32.

Without a stand, a user must continuously and manually squeeze down on a tweezer or false eyelash applicator while the eyelash glue becomes tacky on the false eyelash. The applicator is typically held by a user in an upright position to prevent the eyelash glue from dripping unevenly to one side of the false eyelashes. The user typically must hold the applicator in the closed upright position with their fingers for up to three minutes, which prevents the user from performing other activities with the hand that is holding the tweezer or false eyelash applicator. Typically, this procedure is performed for one false eyelash at a time. In accordance with various aspects of the present invention, the above described stands allow a user to prepare multiple false eyelashes with adhesive at the same time, which greatly expedites this procedure.

For convenience in explanation and accurate definition in the appended claims, the terms "upward," "left" or "right," "inside" and "outside" are used to describe features of the exemplary embodiments with reference to the positions of such features as displayed in the figures.

In many respects, various modified features of the various figures resemble those of preceding features and the same reference numerals followed by subscripts "a", "b" and "c" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An eyelash applicator and stand for hands-free support of a false eyelash, the eyelash applicator and stand comprising:

the eyelash applicator including a pair of lever arms interconnected at a fixed end by a fulcrum, and each lever arm having a tip at a free end, wherein when the lever arms are squeezed together to pinch the tips of the lever arms together in order to engage and hold the false eyelash; and the stand including an elongated slot in a body, the elongated slot having a length L and a width W dimensioned and configured to receive the fulcrum and the lever arms of the eyelash applicator, and the elongated slot having a height H dimensioned and configured to receive a portion of the eyelash applicator lever arms;

wherein the width W is dimensioned and configured to sufficiently squeeze the lever arms together in order to pinch the tips of the lever arms together when the eyelash applicator is inserted into the elongated slot;

wherein the stand further comprises an adjustor for adjusting the width W of the elongated slots in order to accommodate different eyelash applicators of varying sizes; and wherein the adjustor comprises a wedge having a threaded member that extends through the stand body and engages the wedge, tightening the treaded member moves the wedge within the body to bias a side wall of the wedge into the elongated slot to decrease an effective width W of the elongated slot.

2. The eyelash applicator and stand according to claim 1, wherein the tips pinch together when the eyelash applicator is inserted the height H into the elongated slot.

3. The eyelash applicator and stand according to claim 1, wherein the stand comprises a pair of said elongated slots in the body configured to receive a pair of said eyelash applicators in order to support a pair of said false eyelashes.

4. The eyelash applicator and stand according to claim 3, wherein each slot is oriented at an oblique angle to the other slot, whereby the oblique orientation provides clearance between the pair of eyelash applicators to facilitate a user in gripping and removing one of said eyelash applicators from the stand.

5. An eyelash applicator and stand according to claim 1, wherein the stand comprises a plurality of said elongated slots in the body, each configured to receive a respective eyelash applicator.

6. The eyelash applicator and stand according to claim 1, wherein the body is a solid mass defining the elongated slot.

7. The eyelash applicator and stand according to claim 1, wherein the body comprises an outer wall defining the overall shape of the stand and an inner wall defining the elongated slot.

8. The eyelash applicator and stand according to claim 7, wherein the body further comprises a bottom wall defining a bottom of the elongated slot.

9. The eyelash applicator and stand according to claim 7, wherein the stand includes a weight inserted within the outer wall to provide a stable base having a low center of gravity.

10. The eyelash applicator and stand according to claim 1, wherein the stand further comprises a timer for tracking time of drying adhesive that has been applied to the false eyelash held by the eyelash applicator received in the elongated slot.

11. The eyelash applicator and stand according to claim 10, wherein the timer is mounted within the body of the stand.

12. An eyelash applicator and stand for hands-free support of a false eyelash, the eyelash applicator and stand comprising:

the eyelash applicator including a pair of lever arms interconnected at a fixed end by a fulcrum, and each lever arm having a tip at a free end, wherein when the lever arms are squeezed together to pinch the tips of the lever arms together in order to engage and hold the false eyelash; and the stand including an elongated slot in a body, the elongated slot having a length L and a width W dimensioned and configured to receive the fulcrum and the lever arms of the eyelash applicator, and the elongated slot having a height H dimensioned and configured to receive a portion of the eyelash applicator lever arms;

wherein the width W is dimensioned and configured to sufficiently squeeze the lever arms together in order to pinch the tips of the lever arms together when the eyelash applicator is inserted into the elongated slot; and wherein the stand further comprises a fan for directing air toward the tips of an eyelash applicator received within the elongated slot for drying adhesive applied to the false eyelash held by the eyelash applicator.

13. The eyelash applicator and stand according to claim 12, wherein the stand further comprises an adjustor for adjusting the width W of the elongated slots in order to accommodate different eyelash applicators of varying sizes.

14. The eyelash applicator and stand according to claim 13, wherein the adjustor comprises a threaded member that threadably extends through the stand body into the elongated slot, whereby screwing the threaded member into the elongated slot decreases an effective width W of the elongated slot.

15. The eyelash applicator and stand according to claim 12, wherein the fan is mounted within the body of the stand.

16. A stand for hands-free support of an item with tweezers, the tweezers including a pair of lever arms interconnected at a fixed end by a fulcrum, and each lever arm having a tip at a free end, wherein when the lever arms are squeezed together to pinch the tips of the lever arms together in order to engage and hold the item, the stand comprising:

an elongated slot in a body, the elongated slot having a length L and a width W dimensioned and configured to receive the fulcrum and the lever arms of the tweezers, and the elongated slot having a height H dimensioned and configured to receive a portion of the lever arms;

wherein the width W is dimensioned and configured to sufficiently squeeze the lever arms together in order to pinch the tips of the lever arms together when the tweezers are inserted into the elongated slot;

wherein the stand further comprises an adjustor for adjusting the width W of the elongated slots in order to accommodate different tweezers of varying sizes; and wherein the adjustor comprises a threaded member that threadably extends through the stand body into the elongated slot, whereby screwing the threaded member into the elongated slot decreases an effective width W of the elongated slot.

17. The stand according to claim 16, wherein the tips pinch together when the tweezers are inserted the height H into the elongated slot.

* * * * *